US006808398B2

(12) United States Patent
Fan

(10) Patent No.: US 6,808,398 B2
(45) Date of Patent: Oct. 26, 2004

(54) ELECTRICAL CONNECTOR WITH SPACER

(75) Inventor: Chia Hao Fan, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/328,954

(22) Filed: Dec. 23, 2002

(65) Prior Publication Data

US 2004/0121631 A1 Jun. 24, 2004

(51) Int. Cl.[7] ..... H01R 9/09
(52) U.S. Cl. ..... 439/79
(58) Field of Search ..... 439/79, 660, 80, 439/607

(56) References Cited

U.S. PATENT DOCUMENTS 5,199,880 A * 4/1993 Arai ..... 439/65
5,454,734 A * 10/1995 Eggert et al. ..... 439/578
5,711,678 A 1/1998 Wu
6,056,560 A * 5/2000 Wu et al. ..... 439/108
6,162,068 A 12/2000 Wu
6,165,022 A 12/2000 Wu
6,273,732 B1 * 8/2001 Johnescu et al. ..... 439/79

* cited by examiner

*Primary Examiner*—Ross Gushi
*Assistant Examiner*—Phuongchi Nguyen
(74) *Attorney, Agent, or Firm*—Wei Te Chung

(57) ABSTRACT

An electrical connector (1) includes an insulative housing (2), a number of conductive terminals (3), a shell (4) mounted on the insulative housing, a number of grounding tabs (5) and a spacer (6). The housing includes a mating face (20) at a top end thereof, an engaging face (21) opposite to the mating face, opposite side faces (22) extending from the mating face to the engaging face, a depressed face (214) adjacent to the engaging face, a receiving cavity (210) defined by the depressed face, the engaging face and side faces, a number of passageways (204) for receiving the terminals and a pair of engaging portions (224) formed on sides thereof. The spacer received in the receiving cavity includes an upper face (602), a lower face (630), a number of positioning holes (600) and a pair of latching portions (61) extending upwardly for engagement with the engaging portions.

7 Claims, 5 Drawing Sheets

ELECTRICAL CONNECTOR WITH SPACER

CROSS-REFERENCES TO RELATED APPLICATIONS

This application is related to a contemporaneously filed U.S. Patent Application and entitled "ELECTRICAL CONNECTOR WITH SHELL", which is invented by the same inventor and assigned to the same assignee as this application and which is hereby fully incorporated by reference.

BACKGROUND OF THE INVENTION

1. Field of the Invention

The present invention is related to an electrical connector, and more particularly to an electrical connector having a spacer for positioning tails of a plurality of terminals thereof.

2. Description of Related Art

Some conventional high density electrical connectors each comprises an insulative housing, a plurality of contacts, and a spacer assembled to the housing for allowing the contacts extending therethrough. For example, U.S. Pat. No. 5,711,678 discloses such a connector. The spacer of U.S. Pat. No. 5,711,678 is vertically stacked below the insulative housing and is exposed out of the housing. Sometimes, people want electrical connectors having limited heights and having spacers thereof securely retained to housings thereof.

Hence, it is requisite to provide an improved electrical connector to meet the needs.

SUMMARY OF THE INVENTION

Accordingly, an object of the present invention is to provide an electrical connector with a spacer reliably secured therein without increasing thereof.

In order to achieve the object set forth, an electrical connector in accordance with the present invention comprises an insulative housing, a plurality of conductive terminals, a metal shell mounted on the insulative housing, a plurality of grounding tabs mounted on the insulative housing and electrically connected with the shell and a spacer. The housing comprises a mating face at a top end thereof, an engaging face opposite to the mating face, opposite side faces extending from the mating face to the engaging face, a depressed face adjacent to the engaging face, a receiving cavity defined by the depressed face, the engaging face and side faces, a plurality of passageways extending from the mating face to the depressed face and a plurality of engaging portions formed on the opposite side faces thereof. Each terminal has a mating portion received in a corresponding passageway of the insulative housing and a soldering portion extending beyond the insulative housing. The spacer is received in the receiving cavity and comprises an upper face, a lower face, a plurality of positioning holes extending from the upper face to the lower face for allowing the soldering portions of the conductive terminals to extend through and a plurality of latching portions extending upwardly for engagement with the engaging portions. The lower face is substantially coplanar with the engaging face of the housing.

Other objects, advantages and novel features of the invention will become more apparent from the following detailed description of the present embodiment when taken in conjunction with the accompanying drawings.

DETAILED DESCRIPTION OF THE PREFERRED EMBODIMENT

Figure 1:
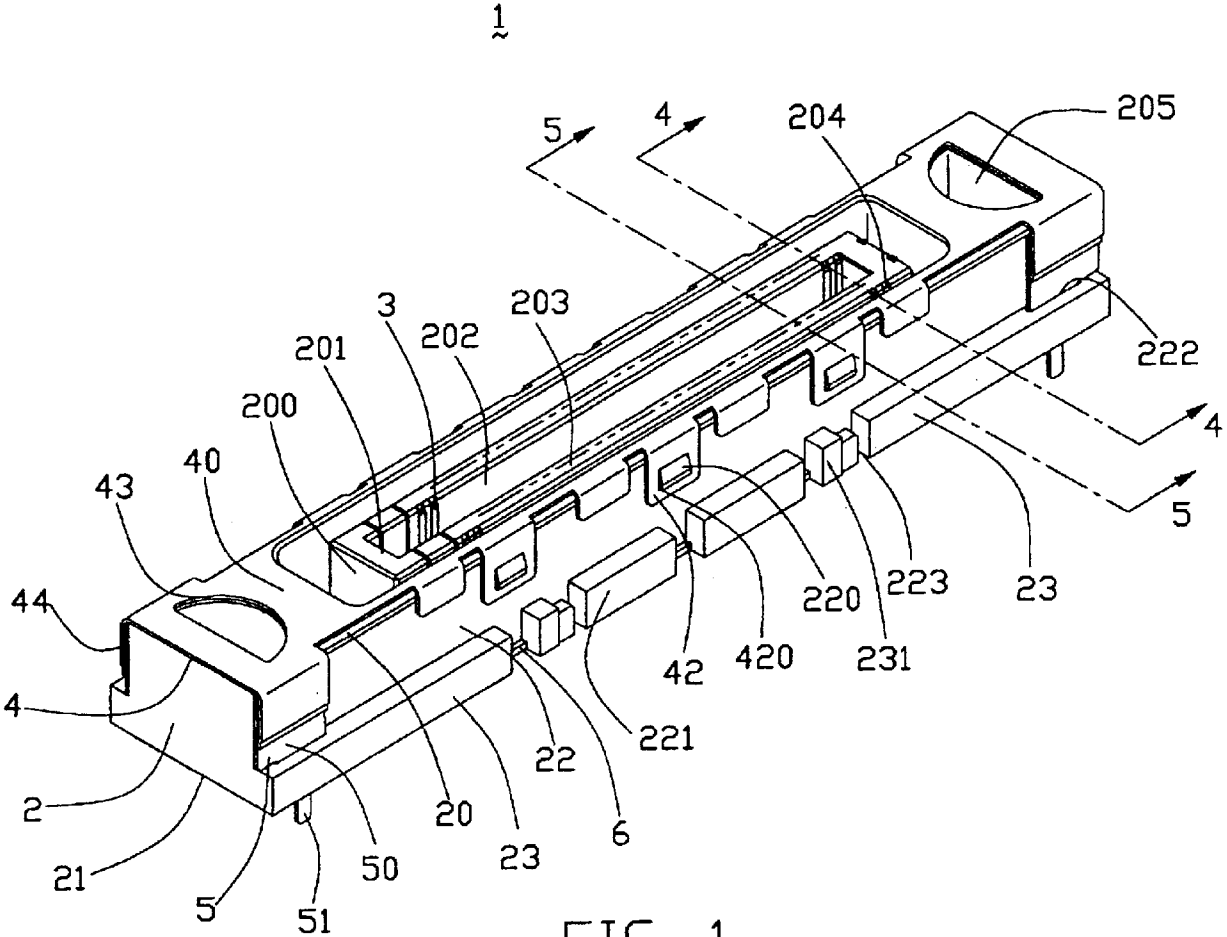
FIG. 1 is an assembled perspective view of an electrical connector in accordance with the present invention.
Figure 2:
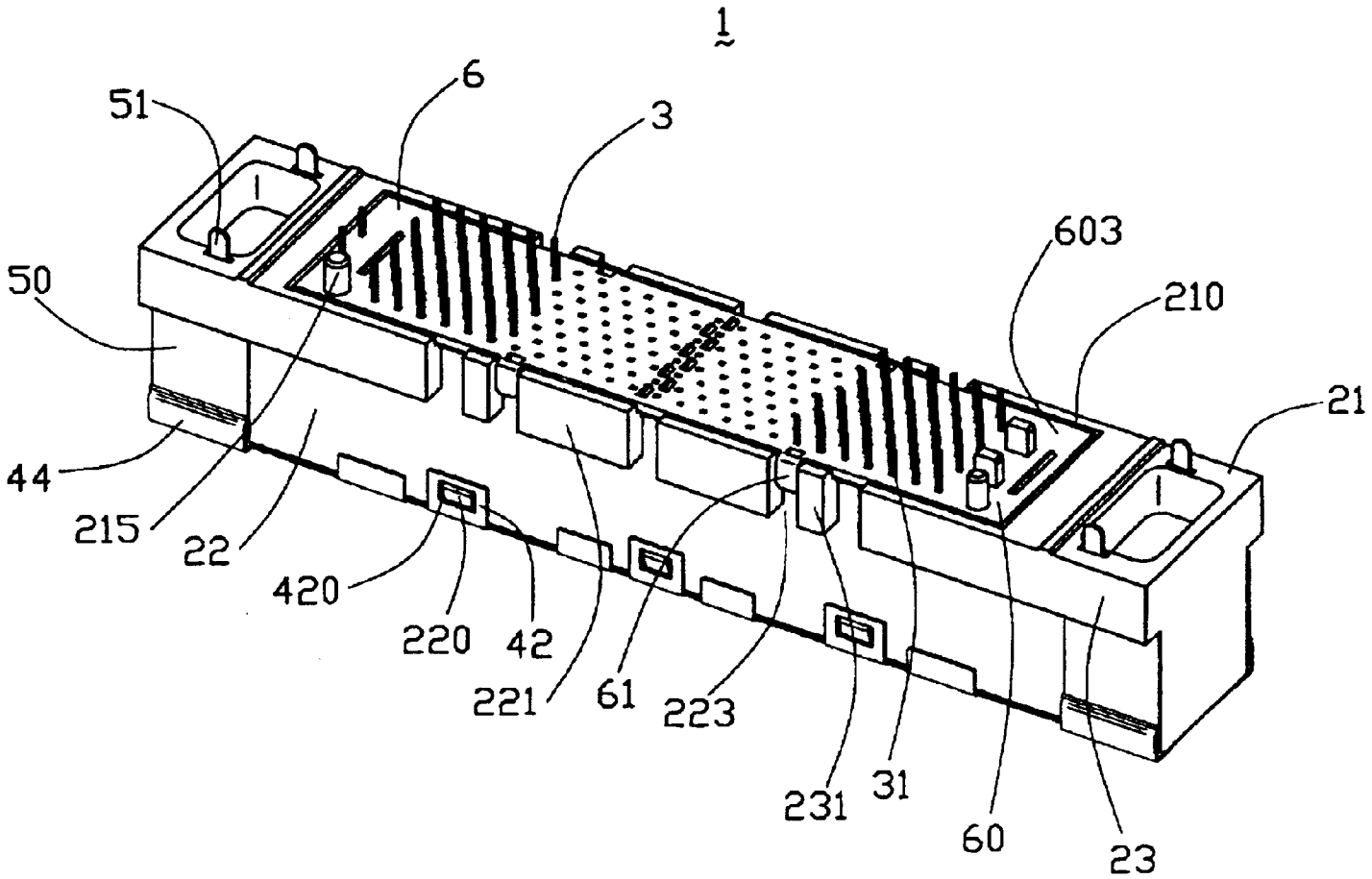
FIG. 2 is a perspective view of the electrical connector of FIG. 1 from a different aspect.

Referring to FIGS. 1 and 2, an electrical connector 1 in accordance with the present invention comprises an insulative housing 2, a plurality of conductive terminals 3 retained in the housing 2, a metal shell 4 mounted on the insulative housing 2, a plurality of grounding tabs 5 and a spacer 6.

Figure 4:
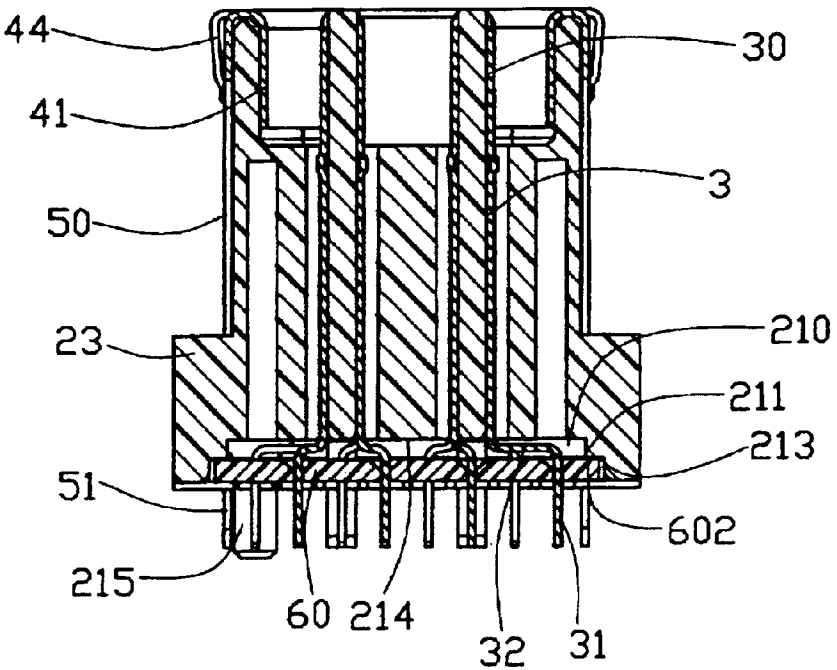
FIG. 4 is a cross-sectional view of the electrical connector taken along line 4—4 of FIG. 1.
Figure 5:
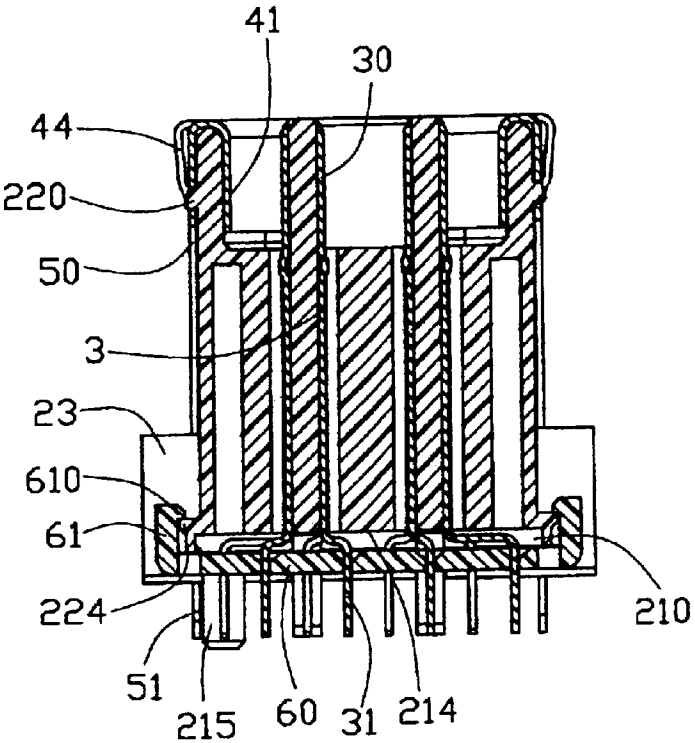
FIG. 5 is a cross-sectional view of the electrical connector taken along line 5—5 of FIG. 1.

Referring to FIGS. 4 and 5 in conjunction with FIGS. 1 and 2, the insulative housing 2 has an elongated configuration. The insulative housing 2 has a mating face 20 on the top thereof, an engaging face 21 opposite to the mating face 20, a depressed face 214 adjacent to the engaging face 21, a mating cavity 200 extending from the mating face 20 toward the depressed face 214, opposite side faces 22 connecting the mating face 20 with the engaging face 21, and a receiving cavity 210 defined by the depressed face 214, the engaging face 21, and the side faces 22. The engaging face 21 faces to a printed circuit board (not shown) on which the electrical connector 1 is mounted. A mating tongue 201 is provided in the mating cavity 200. The mating tongue 201 has opposite sidewalls 203 and a central slot 202 between the sidewalls 203. Each sidewall 203 has a plurality of passageways 204 in opposite side faces 22 thereof. Each passageway 204 extends downwardly from the mating face 20 to the depressed face 214. A pair of guiding holes 205 are defined in opposite ends of the housing 2.

A plurality of protrusions 220 adjacent to the mating face 20 are formed on the opposite side faces 22 of the housing 2. A pair of supporting sections 23 are formed on each side face 22 of the housing 2 and extend to opposite ends of the housing 2. A pair of spaced blocks 221 project outwardly from each side face 22 of the housing 2 and are located between the supporting sections 23. A pair of embossments 231 project outwardly from each side face 22 of the housing 2 and each is separately arranged between one block 221 and a corresponding supporting section 23 adjacent to the block 221. Two cutouts 223 are defined on each side face 22. One cutout 223 is located between one embossment 231 and one supporting section 23, and the other cutout 223 is located between one block 221 and the other embossment 231. A pair of engaging portions 224 are formed on each side face 22 of the housing 2 adjacent to the engaging face 21 and each extends into a corresponding cutout 223. The supporting section 23 has a slit 222 vertically extending therethrough adjacent to one end of the housing 2. Each of the supporting sections 23, the blocks 221 and the embossments 231 has a step portion 211 (FIG. 4) formed on an inner side thereof and a bottom face coplanar with the engaging face 21 of the housing 2.

Each of the supporting sections 23, the blocks 221 and the embossments 231 has a top face which is located on the same level of the housing 2 and higher than a top face of the engaging portion 224. Each step portion 211 has a flat restriction face 213 exposed in the receiving cavity 210 and located between the depressed face 214 and the engaging face 21. A pair of posts 215 extend beyond the engaging face 21 of the housing 2 for positioning the electrical connector 1 onto the printed circuit board.

Each grounding tab 5 has a mating plate 50 and a soldering portion 51 extending downwardly from the mating plate for electrical connection with a grounding trace of the printed circuit board.

The shell 4 is stamped from a metal sheet and has a plate 40. The shell 4 is attached to the insulative housing 2 for providing electromagnetic shielding. The shell 4 defines a plurality of clasping holes 420 in opposite side faces extending from the plate 40 thereof for receiving the protrusions 220 of the insulative housing 2. A pair of resiliently mating pieces 44 extend sidewardly and downwardly from each end of the plate 4. A pair of guiding holes 43 are defined in opposite ends of the shell 4 for communicating with corresponding holes 205 of the housing 2.

Figure 3:
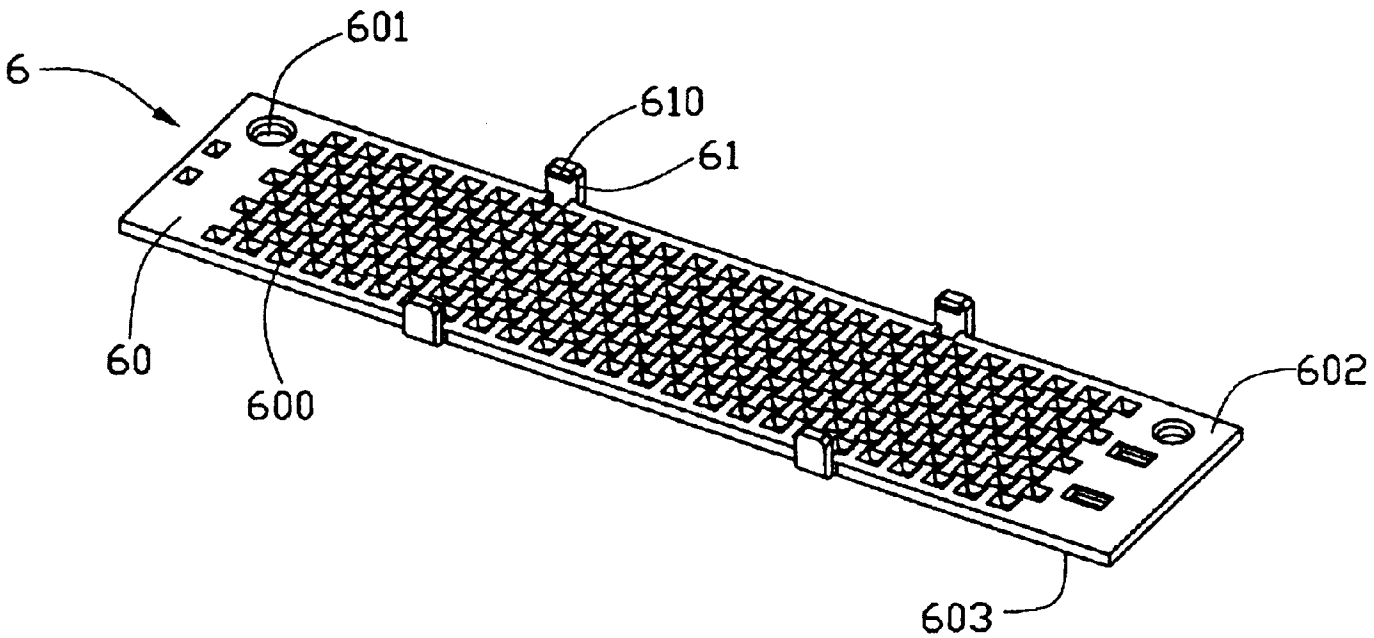
FIG. 3 is a perspective view of a spacer of the electrical connector of FIG. 1.

Referring to FIG. 3, the spacer 6 has an elongated plate 60. The plate 60 has an upper face 602 and a lower face 603. The elongated plate 60 defines a plurality of positioning holes 600 for positioning tails (not shown) of the terminals 3 to downwardly extend therethrough. A pair of latches 61 extend upwardly from each side of the spacer 6 and each has a hook 610 at a free end thereof for engaging with the engaging portion 224 of the housing 2. The spacer 6 has a pair of circular holes 601 in opposite ends thereof.

Referring to FIG. 4, each terminal 3 has a mating portion 30 received in corresponding passageway 204, a soldering portion 31 extending beyond the engaging face 21 of the housing 2 and an intermediate portion 32 interconnecting the mating portion 30 with the soldering portion 31.

Referring to FIGS. 1–5, in assembly, the terminals 3 are assembled into the passageways 204 of the housing 2. The soldering portions 51 of the grounding tabs 5 are inserted into the slits 222 of the supporting sections 23, and extend beyond the engaging face 21 of the housing 2 for being electrically connected with a grounding trace of the printed circuit board.

The shell 4 is assembled into the housing 2 from a top aspect with the clasping holes 420 engaging with the protrusions 220 of the housing 2, and the mating pieces 44 of the shell 4 overlap the grounding tabs 5 for achieving electrical and mechanical connection therebetween.

When the spacer 6 is assembled to the housing 2 from a bottom aspect, the posts 215 extend through the circular holes 601, and the tail portions 31 of the terminals 3 extend beyond the holes of the spacer 6 and the intermediate portions 32 of the terminals 3 are sandwiched between the depressed face 214 of the housing 2 and the upper face 602 of the spacer 6. The latches 61 are received in the cutouts 223 with hooks 610 of the latches 61 engaging with the engaging portions 224 of the housing 2 for preventing the spacer 6 from moving downwardly. The upper face 602 of the spacer 6 abuts against the restriction face 213 of the step portion 211 for preventing the spacer 6 from moving further upwardly.

By engagement between the engaging portions 224 of the housing 2 and hooks 610 of the spacer 6 and the upper face 602 of the spacer 6 abutting against the restriction face of the step portion, the spacer 6 is firmly received in the receiving cavity 210 of the housing 2. Furthermore, the lower face 603 of the spacer 6 is substantially coplanar with the engaging face 21 of the housing 2, so the thickness of the spacer 6 can not increase the height of the housing 2. The spacer 6 is accommodated in the receiving cavity 210 without exposing outside of the housing 2, so the spacer 6 avoids being damaged inadvertently.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising;

an insulative housing comprising a mating face, an engaging face opposite to the mating face, opposite side faces extending from the mating face to the engaging face, a depressed face adjacent to the engaging face, a receiving cavity defined by the depressed face, the engaging face and the side faces, a plurality of passageways extending from the mating face to the depressed face;

a plurality of conductive terminals each comprising a mating portion received in corresponding passageway of the insulative housing and a soldering portion extending beyond the insulative housing and a soldering portion extending beyond the insulative housing; and a spacer received in the receiving cavity and comprising an upper face, a lower face, a plurality of positioning holes extending from the upper face to the lower face for allowing the soldering portion of the conductive terminals to extend through;

the lower face of the spacer being coplanar with the engaging face of the housing;

wherein a shell attached to the insulative housing for providing eletro-magnetic shielding;

wherein a pair of grounding tabs electrically connected with the shell;

wherein the insulative housing comprises a pair of supporting sections formed on side face, thereof and each supposing section defining a slit therethrough, and wherein each grounding tab comprises a mating plate and a soldering portion received by the slit.

2. The electrical connector as claimed in claim 1, wherein the insulative housing comprises a mating tongue and a mating cavity receiving the mating tongue, and wherein said passageway are defined in opposite side surfaces of the mating tongue.

3. The electrical connector as claimed in claim 1, wherein the shell comprises a shielding slot corresponding to the mating cavity of the insulative housing, and two mating pieces at opposite respective ends of the shielding slot for electrical connection with the mating plates of the grounding tabs.

4. The electrical connector as claimed in claim 1, wherein the supporting portion has a step portion formed on inner side thereof, the step portion having a restriction face exposed to the receiving cavity and located between the depressed face and the engaging face for abutting against the upper face of the spacer.

5. The electrical connector as claimed in claim 1, wherein the terminal comprises an intermediate portion interconnecting the mating portion with the soldering portion, the intermediate portion being sandwiched between the depressed of the housing and the upper face of the spacer.

6. An electrical connector, comprising:

an insulative housing comprising a mating face at a top end thereof, an engaging face opposite to the mating face, a plurality of passageways extending from the mating face toward the engaging face, a pair of engaging portions formed on low end of longitudinal sides thereof and a restriction face adjacent to the engaging face;

a plurality of conductive terminals retained to the housing and each comprising a mating portion received in corresponding passageway of the insulative housing and a soldering portion extending beyond the insulative housing; and a spacer comprising an upper face, a lower face, a plurality of positioning holes extending from the upper face to the lower face for allowing the soldering portion of the conductive terminals to extend through and a pair of latching portions extending upwardly for engagement with the engaging portions, the upper face abutting against said restriction face;

wherein the insulative housing comprises a pair of posts extending beyond the engaging face thereof, the spacer comparing a pair of circular holes for allowing the posts to extend therethrough;

wherein the lower face of the spacer is substantially coplanar with the engaging face of the housing.

7. The electrical connector as claimed in claim 6, wherein the insulative housing comprises a pair of supporting sections formed on side faces thereof and extending to opposite ends thereof, said restriction face being formed on an inner side of the supporting section.

* * * * *